US012378747B2

(12) United States Patent
Thompson et al.

(10) Patent No.: US 12,378,747 B2
(45) Date of Patent: Aug. 5, 2025

(54) UNIVERSAL HYDRAULIC AUXILIARY DEPRESSURIZATION CIRCUIT

(71) Applicant: Caterpillar Inc., Peoria, IL (US)

(72) Inventors: Mark W. Thompson, Manhattan, KS (US); Jeffrey R. Peterson, Wamego, KS (US); Trent R. Stefek, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 730 days.

(21) Appl. No.: 17/739,542

(22) Filed: May 9, 2022

(65) Prior Publication Data

US 2023/0358012 A1 Nov. 9, 2023

(51) Int. Cl.
*E02F 3/36* (2006.01)

(52) U.S. Cl.
CPC ..... *E02F 3/3663* (2013.01); *E02F 3/3627* (2013.01)

(58) Field of Classification Search
CPC ..... E02F 9/226; E02F 3/3663; E02F 3/3659; E02F 3/3654
See application file for complete search history.

(56) References Cited

U.S. PATENT DOCUMENTS 6,318,234 B1 11/2001 Mate
7,198,060 B2 4/2007 Hiser
11,105,063 B2 8/2021 Sato
2013/0160441 A1 6/2013 Yokohata
2016/0348799 A1 12/2016 Preston et al.
2020/0217040 A1* 7/2020 Hill ..... F16K 31/42

FOREIGN PATENT DOCUMENTS

DE 102010036545 B4 1/2015

OTHER PUBLICATIONS

Written Opinion and International Search Report for Int'l. Patent Appln. No. PCT/US2023/019881, mailed Jul. 31, 2023 (10 pgs).

* cited by examiner

*Primary Examiner* — Kenneth Bomberg
*Assistant Examiner* — Daniel S Collins

(57) ABSTRACT

A hydraulic system for depressurizing a work tool auxiliary circuit of a work machine. The system comprises: a power source; a reservoir of hydraulic fluid, a plurality of hydraulic lines, a pressure source, a control valve, a depressurize line connected to at least one of the plurality of hydraulic lines and the reservoir, the depressurize line includes an electromechanical valve for regulating the flow of hydraulic fluid in the depressurize line; a controller and a coupler switch comprising at least two throws and having three positions where one of the three positions actuates the electromechanical valve to depressurize the work tool auxiliary circuit. The hydraulic system can be provided as a kit to existing work machines for depressurizing the work tool hydraulic auxiliary circuit of a work machine.

20 Claims, 7 Drawing Sheets

UNIVERSAL HYDRAULIC AUXILIARY DEPRESSURIZATION CIRCUIT

TECHNICAL FIELD

The present disclosure generally relates to hydraulic systems in a work machine, and more particularly relates to depressurizing hydraulic work tool auxiliary circuits.

BACKGROUND

Work machines such as an excavator, backhoe, skid steer, wheel loader, tractor, etc., are further provided with a quick coupler that is used to attach and detach various work tool attachments commonly referred to as implements to the work machine. More specifically, some implements are connected at the end of a working mechanism generally known as the boom and arm of a work machine. Generally, quick couplers are heavy-duty industrial components that allow for the fast and efficient changing of buckets, hammers, grapples, compactors, rakes, and other implements to the arm of a work machine. Without a quick coupler, workers are required to manually drive out pins, typically using a hammer.

Hydraulic connecting quick couplers provide an improvement over the standard quick couplers. Standard quick couplers only physically connect the work implement to the machine and still require the hydraulic lines to be manually connected. Hydraulic connecting quick couplers physically connect both the implement as well as the hydraulic lines, if equipped, to the machine. Hydraulic connecting quick couplers allow for a work machine to be able to switch between different hydromechanical or non-hydromechanical work tools quickly by using the hydraulic system of the work machine and can be operated by a control device from the cab of the work machine. The hydraulic system of the work machine generally connects to the hydraulic connecting quick couplers via hydraulic lines in the hydraulic system. Hydraulic lines are generally provided throughout the work machine. The hydraulic lines generally utilize hydraulic couplings which create fluid tight seals to maintain pressure of hydraulic fluid in the circuit. Additionally, work implements may comprise a hydraulic auxiliary circuit that connect with hydraulic connecting quick couplers. Hydraulic connecting quick couplers require depressurization of the auxiliary hydraulic circuit to be able to fully connect properly. Generally, the coupler switch existing on a work machine is only provided with two switch positions, lock and unlock.

Others have disclosed hydraulic circuits for actuating attachment and detachment of the work tool to and from a quick coupler, but fail to provide a separate depressurization line for depressurizing the hydraulic auxiliary circuit of the work tool. For example, US Publication No. 2020/0217040 to Hill discloses a coupling system comprising a coupler and a depressurization system, wherein a first power coupling unit of the coupler comprises at least one hydraulic coupling for connection to a hydraulic line of a hydraulic system of an excavator or other machine, and wherein said depressurization system comprises: a depressurization valve device for selectively connecting the hydraulic line to a hydraulic fluid reservoir in order to dump hydraulic fluid from the hydraulic line to a reservoir; and a control device for operating the depressurization valve device, the control device being configured to detect operation of the coupler out of a locking state or into a locking state, wherein the control device is configured to, in response to detecting operation of the coupler out of the locking state, operate the depressurization valve device to connect the hydraulic line to the hydraulic fluid reservoir in order to dump hydraulic fluid from the hydraulic line to the reservoir, and in response to detecting operation of the coupler into a locking state, to operate the depressurization valve device to prevent hydraulic fluid being dumped from the hydraulic line to the reservoir. Hill fails to disclose a control switch having three positions for selectively choosing a depressurization function to separately depressurize the hydraulic auxiliary circuit of a work tool.

It can therefore be seen that a need exists for an improved hydraulic system which facilitates attaching and detaching work implements to quick couplers as well as a need to upgrade existing hydraulic systems of a work machine in the field to accommodate for hydraulic connecting quick couplers.

SUMMARY OF THE DISCLOSURE

In accordance with one aspect of the disclosure, a hydraulic system for depressurizing a work tool auxiliary circuit of a work machine is disclosed herein. The system comprising: a power source for powering the hydraulic system; a reservoir of hydraulic fluid; a plurality of hydraulic lines; a pressure source for supplying the hydraulic fluid throughout the plurality of hydraulic lines; a control valve for regulating a flow of the hydraulic fluid; a depressurize line connected to at least one of the plurality of hydraulic lines and the reservoir, the depressurize line includes an electromechanical valve for regulating the flow of hydraulic fluid in the depressurize line; a controller configured to communicate with the electromechanical valve via a power circuit; and a coupler switch comprising three positions configured to communicate with the controller, at least one of the three positions actuates the electromechanical valve to depressurize the work tool auxiliary circuit.

In accordance with another aspect of the disclosure, a work machine is disclosed comprising: a frame; a ground engaging element supporting the frame; an engine in the frame and powers the work machine; a working mechanism extending from the frame; a quick coupler on the end of the working mechanism for coupling to a work tool; a hydraulic system including: a power source for powering the hydraulic system; a reservoir of hydraulic fluid; a plurality of hydraulic lines; a pressure source for supplying the hydraulic fluid throughout the plurality of hydraulic lines; a control valve for regulating a flow of the hydraulic fluid; a depressurize line connected to at least one of the plurality of hydraulic lines and the reservoir, the depressurize line includes an electromechanical valve for regulating the flow of hydraulic fluid in the depressurize line; a controller configured to communicate with the electromechanical valve via a power circuit; and a coupler switch comprising three positions configured to communicate with the controller, at least one of the three positions actuates the electromechanical valve to depressurize the work tool auxiliary circuit.

In accordance with another aspect of the disclosure, a method of depressurizing a work tool auxiliary circuit of a work machine is disclosed. The hydraulic system includes a plurality of hydraulic lines, a pump, a reservoir of hydraulic fluid, and a power circuit having a controller. The method comprises: providing the work machine; installing a coupler switch having three positions in connection with the controller, at least one of the three positions depressurizes the work tool auxiliary circuit; installing a depressurization circuit and a relay to the controller; installing a depressurize line and an electromechanical valve to the plurality of hydraulic lines, the reservoir, the electromechanical valve in communication with the relay; and depressurizing the work tool auxiliary circuit when a depressurize position is selected actuating the electromechanical valve to release pressure in the work tool auxiliary circuit.

These and other aspects and features of the present disclosure will be better understood upon reading the following detailed description when read in conjunction with the accompanying drawings.

The figures depict one embodiment of the presented invention for purposes of illustration only. One skilled in the art will readily recognize from the following discussion that alternative embodiments of the structures and methods illustrated herein may be employed without departing from the principles described herein.

DETAILED DESCRIPTION

Figure 1:
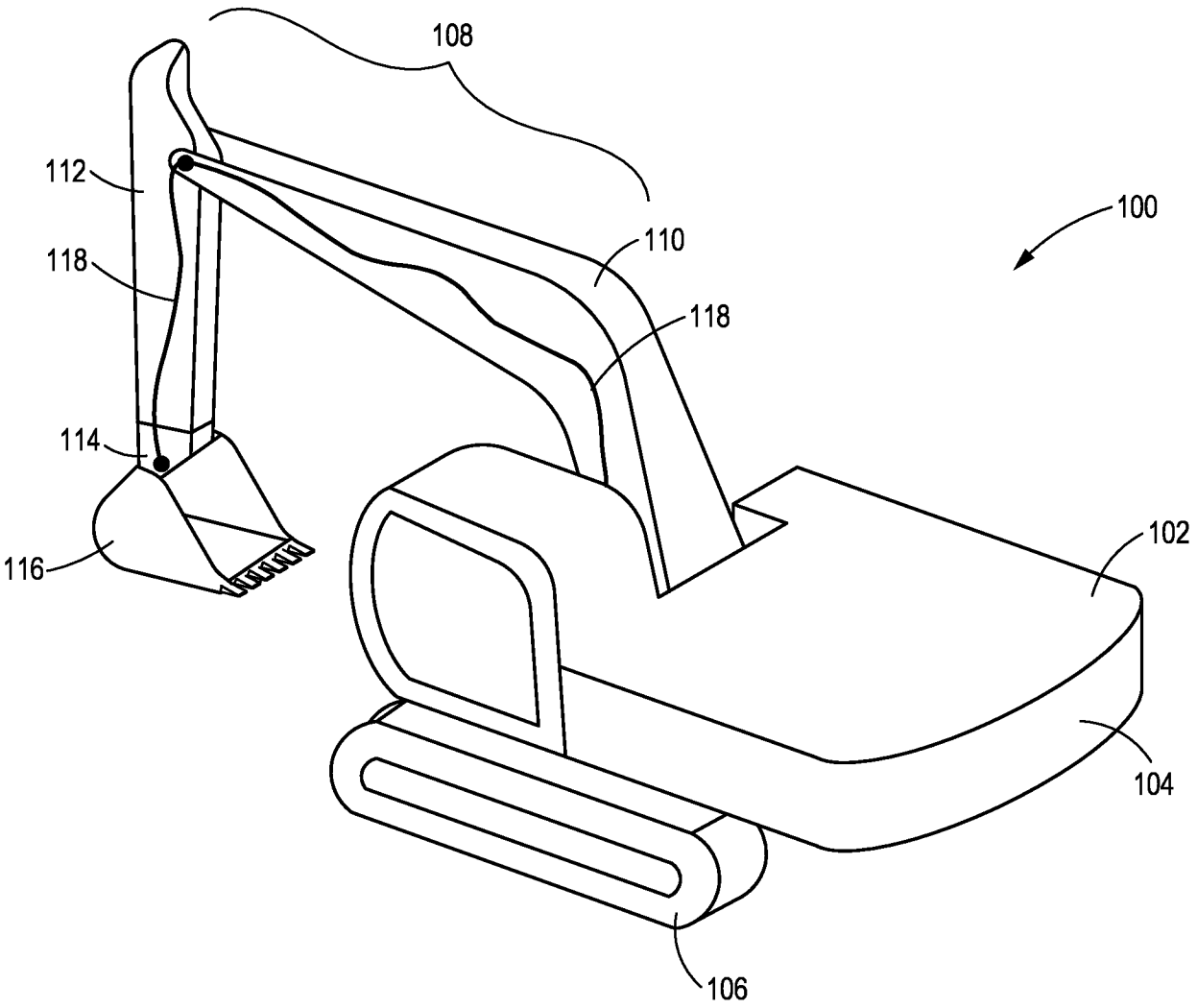
FIG. 1 is a perspective view of a work machine comprising a quick coupler coupled to a work tool comprising the hydraulic quick coupler circuit, according to an embodiment of the present disclosure.

Referring now to the drawings, and with specific reference to FIG. 1, an exemplary work machine 100 is shown, illustrated as an excavator. Excavators are heavy equipment designed to move earth material from the ground or landscape at a dig site in the construction and agricultural industries. While the following detailed description describes an exemplary aspect in connection with the excavator, it should be appreciated that the description applies equally to the use of the present disclosure in other work machines including but not limited to backhoes, front-end loaders, skid steers, wheel loaders, and tractors, as well.

The work machine 100 comprises a frame 102 supporting an engine 104. The frame 102 is supported on ground engaging elements 106 illustrated as continuous tracks. It should be contemplated that the ground engaging elements 106 may be any other type of ground engaging elements 106 such as, for example, wheels, etc. The work machine 100 further includes a working mechanism 108 extending from the frame for conducting work, such as, for example, excavating landscapes or otherwise moving earth, soil, or other material at a dig site. The frame 102 may be an upper swiveling body common with excavators and work machines in the agricultural and construction industries.

As illustrated in one embodiment, the working mechanism 108 includes a boom 110, an arm 112, a quick coupler 114, and a work tool 116 used to remove earth, soil, and other material from a landscape site. The work tool 116 may be a bucket, dipper, hammer, thumb, hydromechanical tool, or other attachment that couples to the quick coupler 114 for operation by the work machine 100.

The work machine 100 utilizes the quick coupler 114 to attach and detach the work tool 116 to the work machine 100. The work machine 100 can quickly attach and detach the work tool 116 to the quick coupler 114 by using a plurality of hydraulic lines 118 provided on the work machine. In one embodiment, the quick coupler 114 is a hydraulic connecting quick coupler configured to connect to the plurality of hydraulic lines 118.

Figure 3:
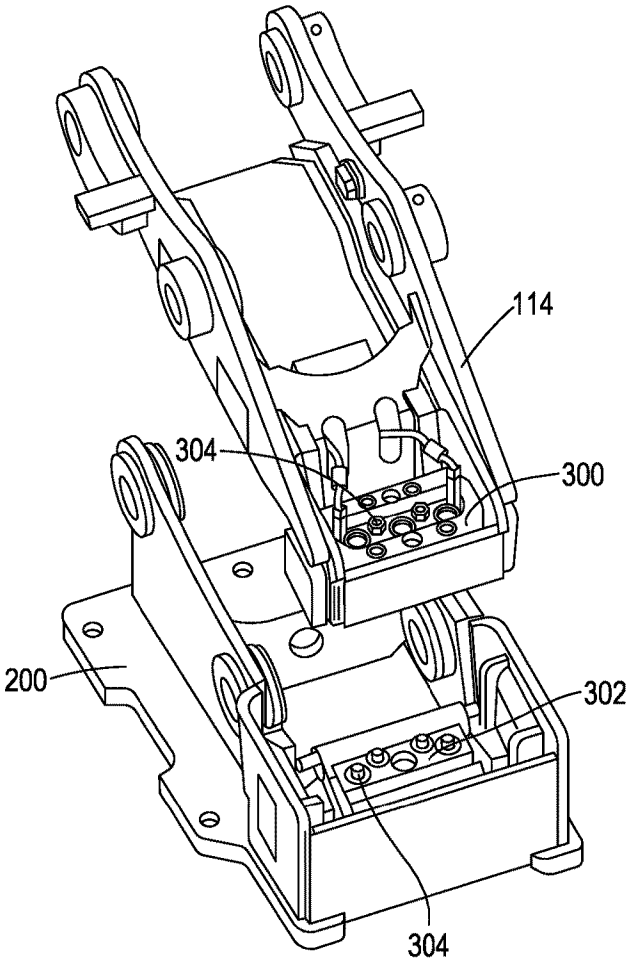
FIG. 3 is an enlarged, perspective view of a hydraulic connecting quick coupler and a work tool bracket, according to an embodiment.
Figure 2:
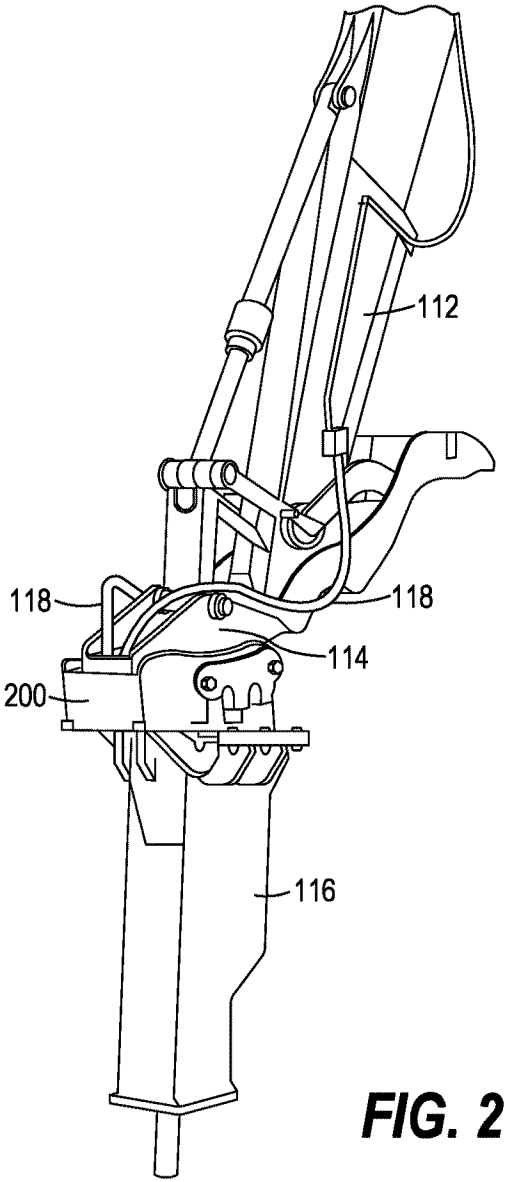
FIG. 2 is an enlarged, perspective view of an arm of a work machine comprising a quick coupler coupled to a work tool, according to an embodiment of the present disclosure.

Referring now to FIGS. 2-3, in one embodiment, the quick coupler 114 is illustrated as a hydraulic connecting quick coupler attached to the work tool 116. As illustrated in FIG. 2, the quick coupler 114 is connected to a work tool bracket 200 which is further connected to the work tool 116. The quick coupler 114 comprises a quick coupler coupling 300 which mates with a work tool coupling 302 in the work tool bracket 200. The quick coupler coupling 300 and work tool coupling 302 may also be referred to as a hydraulic block which hydraulically connects and disconnects the quick coupler 114 from the work tool bracket 200. The plurality of hydraulic lines 118 is connected to the hydraulic block via hydraulic couplings 304 attached to the quick coupler coupling 300 side of the hydraulic block. Hydraulic couplings 304 create a fluid tight seal to maintain pressure and allow equipment changes in fluid and gas transfer, tool assembly, diagnostics, and other tasks that require frequent swapping out of equipment. Hydraulic couplings generally have two parts: a coupling body (socket or female end) and a coupling plug (male end) that connect the plurality of hydraulic lines 118 to the quick coupler coupling 300 of the quick coupler 114. Hydraulic coupling connection types may include push-to-connect, pull-to-connect, threaded connections, and universal interchanges generally known in the arts. The hydraulic couplings control spills, air inclusion, and disconnects with special features such as flush-face designs, self-sealing poppet valves, single- or double-shutoff valves, and sleeves (automatic, manual, locking).

It may be recognized that in some applications of the work machine 100 only one hydraulic line 118 is required to connect to the quick coupler coupling 300, while in other applications of work tools and quick couplers, a plurality of hydraulic lines 118 and a plurality of hydraulic couplings 304 may be required. In other work machines, such as mulchers, there may be up to five hydraulic lines 118. The plurality of hydraulic lines 118 may comprise of primary hydraulic lines and secondary hydraulic lines. Primary hydraulic lines are utilized as the main operations of the work tool 116. The secondary hydraulic lines are utilized to for secondary operations such as rotating, tilting, opening, and closing of the work tool 116.

Figure 4:
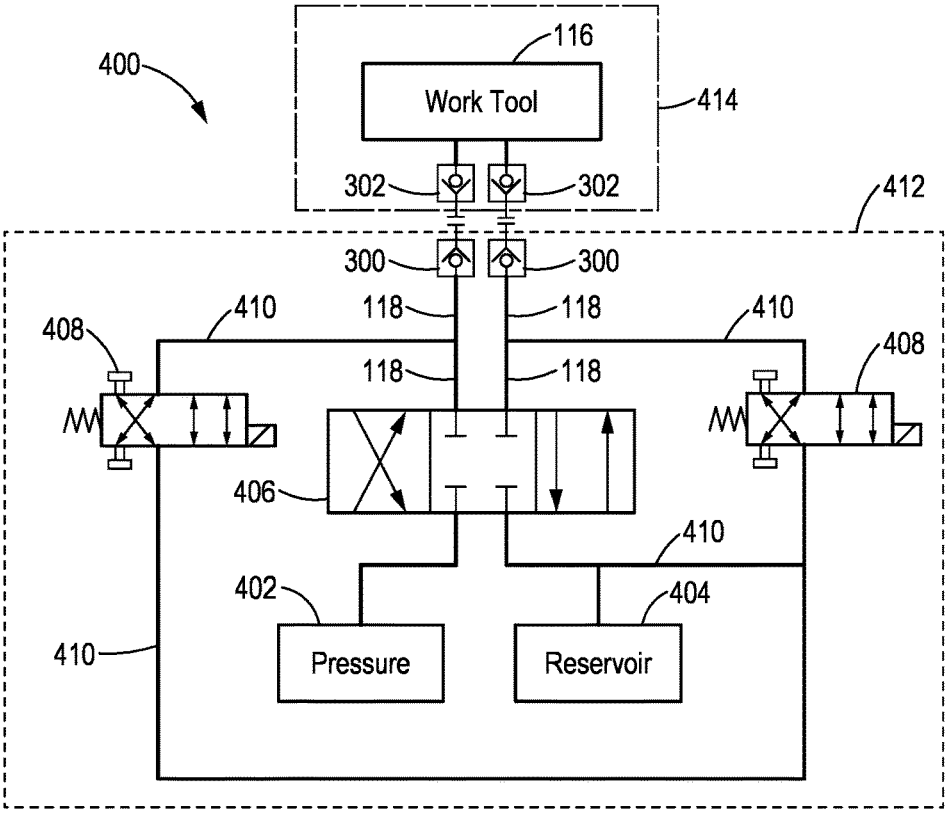
FIG. 4 is a schematic diagram that illustrates a hydraulic circuit for a work machine with the work tool disconnected to the work machine, according to an embodiment of the present disclosure.
Figure 5:
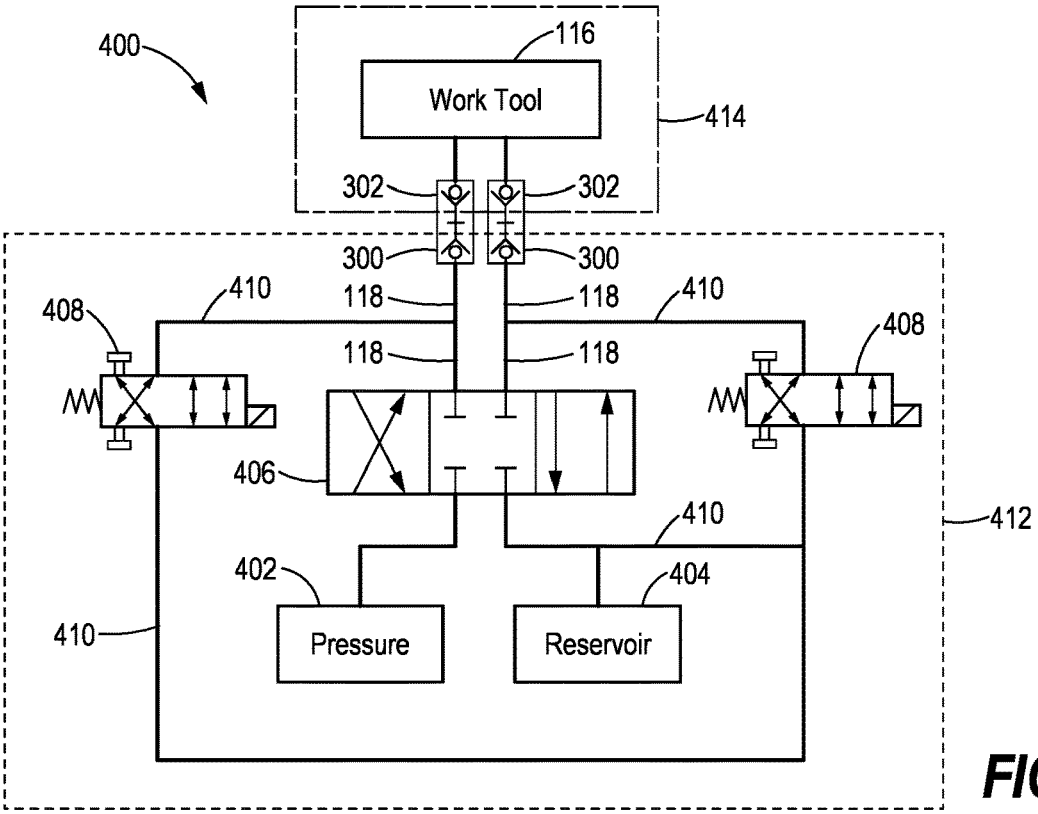
FIG. 5 is a schematic diagram that illustrates a hydraulic circuit for a work machine with the work tool connected to the work machine, according to an embodiment of the present disclosure.

Referring now to FIGS. 4-5, in one embodiment, a schematic of a work tool auxiliary circuit 400 is illustrated with the work tool 116 hydraulically disconnected to the work machine 100, as shown in FIG. 4, and the work tool 116 hydraulically connected to the work machine 100, as shown in FIG. 5. The work tool auxiliary circuit 400 comprises the plurality of hydraulic lines 118, a pressure source 402 for pumping hydraulic fluid throughout the work tool auxiliary circuit 400 creating pressure within the plurality of hydraulic lines 118, a reservoir 404 for storing the supply of hydraulic fluid, a control valve 406 for regulating the distribution of hydraulic fluid pumped by the pressure source 402 throughout the work tool auxiliary circuit 400 and the plurality of hydraulic lines 118, an electromechanical valve 408 for releasing pressure within the work tool auxiliary circuit 400, and a depressurize line 410. The electromechanical valve 408 connects to the work tool auxiliary circuit 400 by connecting a depressurize line 410 to at least one of the plurality of hydraulic lines 118 and the reservoir 404. FIGS. 4-5 illustrate the components of the work tool auxiliary circuit 400 situated in the work machine 100 on a work machine side 412 and a work tool side 414.

The pressure source 402 may be a pump or other pressure source capable to supplying hydraulic fluid throughout a hydraulic circuit, as generally known in the arts. The reservoir 404 may be a tank or the like for storing hydraulic fluid. The control valve 406 may be a spool valve, a directional control valve, an electronically controlled valve, or the like. The electromechanical valve 408 may be a depressurization valve, a solenoid valve, or other valve.

The work tool auxiliary circuit 400 may utilize a variety of hydraulic fluid stored and supplied in the reservoir 404 such as oil, water, gas, or other generally known fluid used for hydraulic circuits and hydraulic systems, as generally known in the arts.

When the electromechanical valve 408 is actuated, the electromechanical valve 408 releases pressure for depressurizing the work tool auxiliary circuit 400. The depressurization by the electromechanical valve 408 releases the pressure in the work tool auxiliary circuit 400 by temporarily connecting a side of the work tool auxiliary circuit 400 to the reservoir 404. The depressurize line 410 is connected to the plurality of hydraulic lines 118 so that when the electromechanical valve 408 is actuated the hydraulic fluid is released from the plurality of hydraulic lines 118 and returned to the reservoir 404.

As illustrated in FIGS. 4-5, the depressurization releases the pressure in the work tool auxiliary circuit 400 comprising two hydraulic lines 118 by temporarily connecting both hydraulic lines 118 on each side of the work tool auxiliary circuit 400 to the reservoir 404 and by connecting the electromechanical valve 408 to each of the two hydraulic lines 118 on each side of the work tool auxiliary circuit 400. In a standard work machine, the hydraulic pressure flow is applied directly to the work tool 116 in a standard hydraulic auxiliary circuit that utilizes at least one of the plurality of hydraulic lines 118, also referred to the auxiliary line illustrated in FIGS. 4-5 as the plurality of hydraulic lines 118. Connecting the electromechanical valve 408 and the depressurize line 410 to the auxiliary line allows for the pressure applied directly to the work tool 116 to depressurize when the electromechanical valve 408 is actuated. FIGS. 4-5 do not show the hydraulic control circuit that also generally connects to the pressure source 402 and reservoir 404 for other control operations such as locking and unlocking of the quick coupler 114 to the work tool 116.

Figure 6:
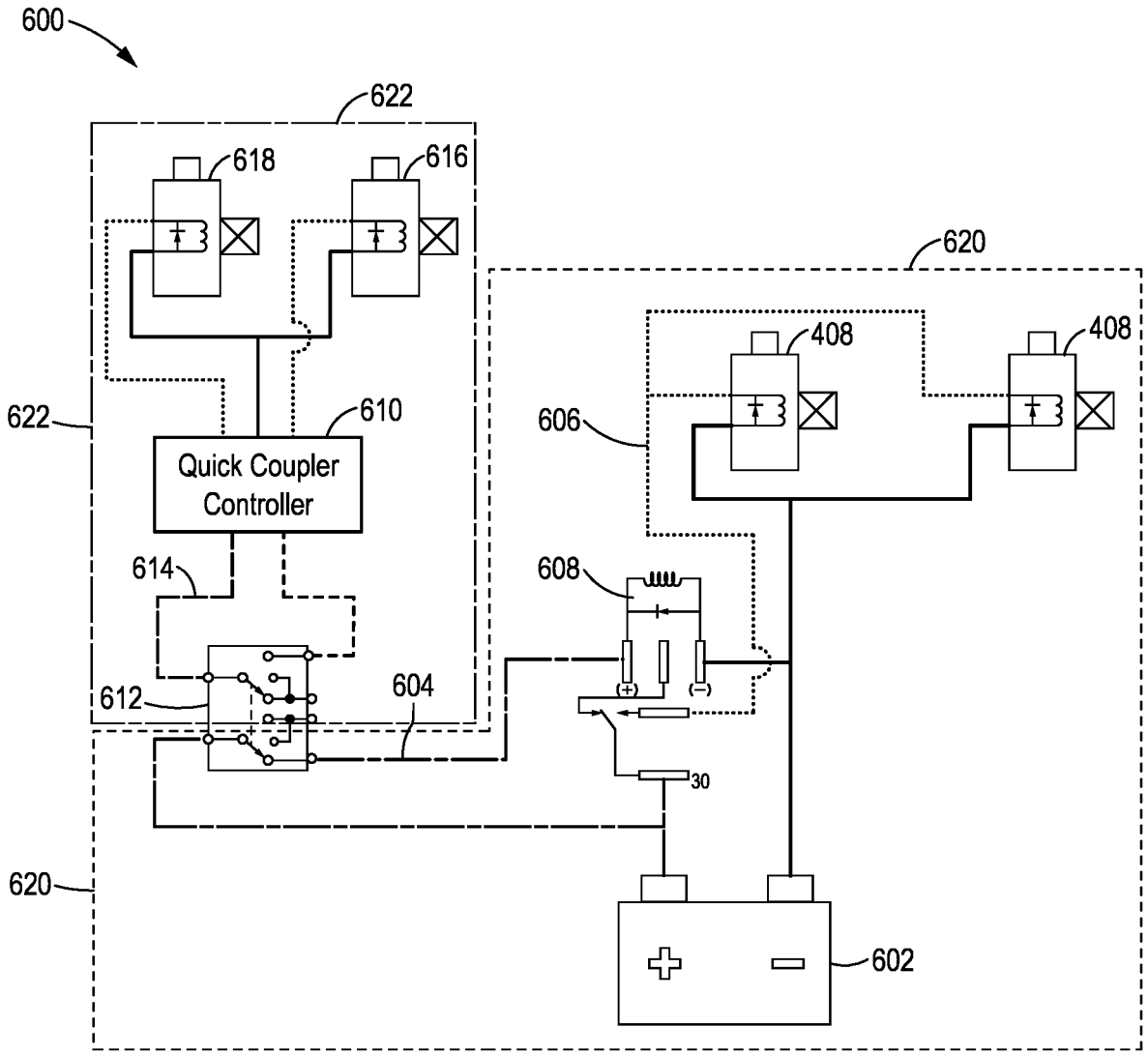
FIG. 6 is a schematic diagram that illustrates a power circuit for providing power to the hydraulic circuit, according to an embodiment.

Referring now to FIG. 6, a power circuit 600 for providing electrical power to the work tool auxiliary circuit 400 is illustrated in one embodiment of the present disclosure. The power circuit 600 comprises a power source 602 for providing electrical power, an activation circuit 604, a relay circuit 606, a relay 608, the electromechanical valve 408, a quick coupler controller 610, and a coupler switch 612. As illustrated, the quick coupler controller 610 is electrically connected to the coupler switch 612 which is electrically connected to the relay 608 via the activation circuit 604, the relay 608 is electrically connected to the electromechanical valve 408 via the relay circuit 606. The coupler switch 612 is electrically connected to the quick coupler controller 610 via a controller circuit 614. The quick coupler controller 610 is also electrically connected to a lock valve 616 and an unlock valve 618.

The power circuit 600 can be viewed as two separate circuits, a depressurization circuit 620 and a locking circuit 622. The locking circuit 622 controls the unlocking and locking of the work tool 116 to the quick coupler 114 in a standard work machine. The depressurization circuit 620 is installed to a standard work machine's by upgrading the coupler switch 612 and installing the relay 608, the activation circuit 604, the depressurize circuit, and the electromechanical valve 408. The depressurization circuit 620 is electrically connected to the power source 602 of the work machine 100. It may be recognized by one skilled in the art that the locking circuit 622 may directly connect to the power source 602. The position of the power source 602 may change as recognized by one skilled in the art. The power source 602 may be a battery or the like.

The coupler switch 612 may comprise at least two throws such as a double throw switch. The number of throws corresponds to the number of possible output connections that can be made by a switch. The coupler switch 612 is provided with at least three positions with various configurations for various applications of the work machine 100 utilizing various work tools in a variety of environments. For example, the three switch positions in a first configuration may be set as (1) Coupler locked, (2) coupler unlock, and (3) coupler unlock and depressurize. This first configuration also helps prevent tool drift when needed. Tool drift is movement in the work tool 116 during a loss of hydraulic pressure in the work tool auxiliary circuit 400. For example, the tines on a thumb or grapple might currently being held open from the hydraulic pressure within the work tool auxiliary circuit 400. If the hydraulic circuit of the work machine 100 is depressurized, the work tool 116 may start to close or drift towards closure from the gravitational force and/or from a lack of hydraulic pressure.

The three switch positions of the coupler switch 612 in a second configuration may be set as (1) Depressurize, (2) Coupler Locked, and (3) Coupler Unlocked. This configuration allows for depressurization of the auxiliary hydraulic circuit of the work tool 116 to be independent from the coupler unlock switch selection. For some applications of the work machine 100, the duration of the depressurization process needs to be limited to limit tool drift while also requiring the depressurization process to occur prior to disengaging the coupler.

In a third configuration, for example, the three switch positions of the coupler switch 612 may be set as (1) Coupler Lock, (2) Depressurize, and (3) Coupler Unlock and Depressurize. This configuration forces the operator of the work machine 100 to utilize the depressurization function. Some hydraulic connecting quick couplers require depressurization all the time during the coupling process. This configuration requires the operator to always be required to depressurize the work tool auxiliary circuit 400 when unlocking the quick coupler 114 from the work tool 116.

Any combination of the three-positions may be chosen in accordance with the application of the work machine 100, the quick coupler 114 type, and the work tool 116 type, by a person having ordinary skills in the arts.

INDUSTRIAL APPLICABILITY

In operation, the present disclosure may find applicability in many industries including, but not limited to, the construction, earth-moving, and agricultural industries. Specifically, the technology of the present disclosure may be used for hydraulic depressurization in work machines including, but not limited to, excavators, backhoes, skid steers, wheel loaders, tractors, and the like, comprising a quick coupler for easily connecting and disconnecting work tools such as hammers, buckets, dippers, dig tools, and the like. While the foregoing detailed description is made with specific reference to excavators, it is to be understood that its teachings may also be applied onto the other work machines such as backhoes, skid steers, wheel loaders, tractors, mulchers, and the like.

It may be recognized to a person skilled in the arts that the foregoing hydraulic system may be provided as a universal depressurization kit for installing onto a wide range of machine sizes and machine types. This universal depressurization kit of the hydraulic system disclosed herein will allow the operator to be able to depressurize the work tool auxiliary circuit 400 without connecting to the hydraulic control circuit of the work tool 116. The depressurization of the work tool auxiliary circuit 400 can be operated from the comfort of the cab with a minimal amount of effort. The universal depressurization kit consists of configuring the power circuit 600 and work tool auxiliary circuit 400 of the work machine 100 with the electromechanical valve 408, the depressurize line 410, the coupler switch 612 with at least two throws, and the relay 608, which gets installed to the work machine 100.

Figure 7:
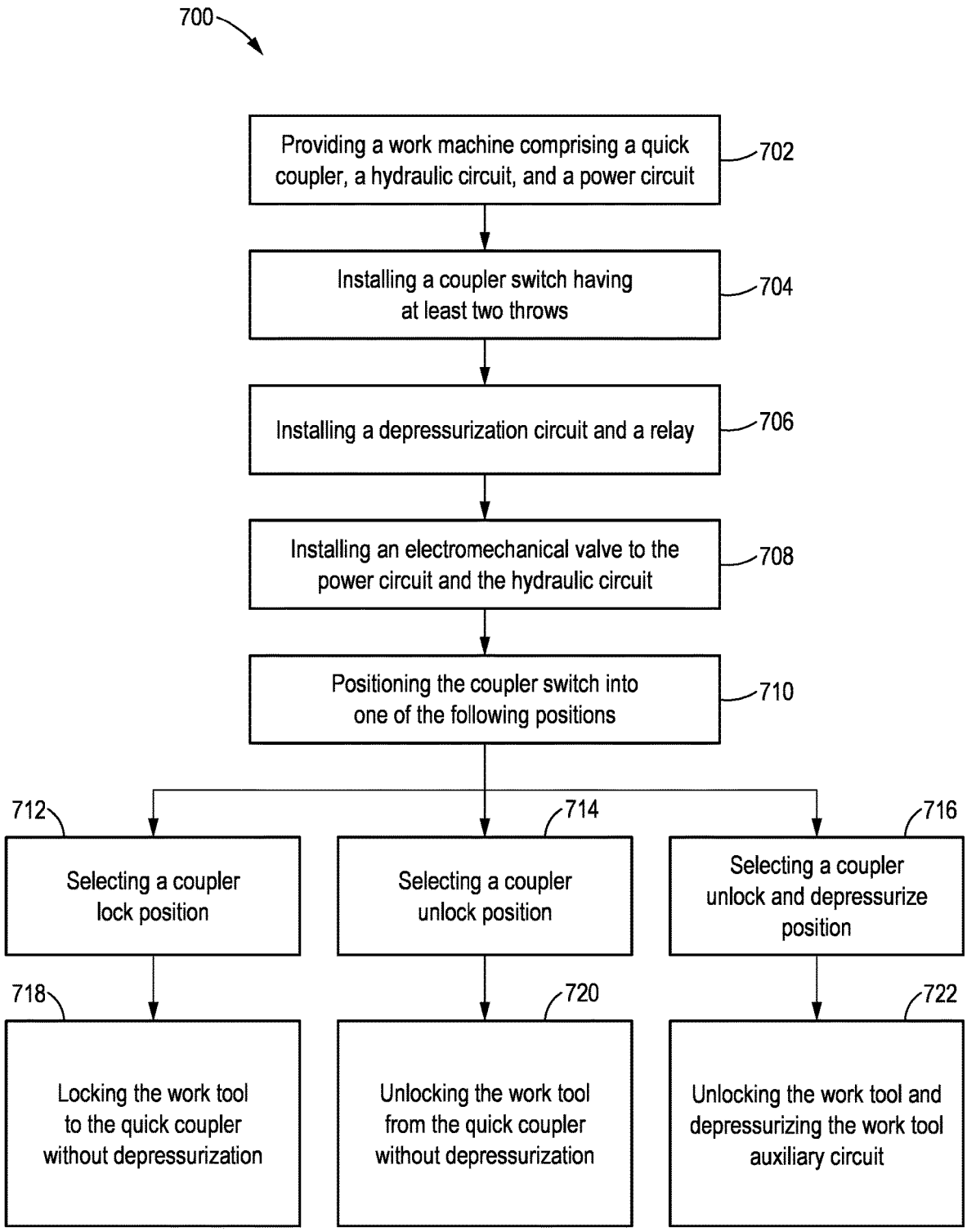
FIG. 7 is a flow chart of a method of installing a depressurization kit of the hydraulic circuit on a work machine and selecting a function of a three-position coupler switch, according to a first embodiment.
Figure 8:
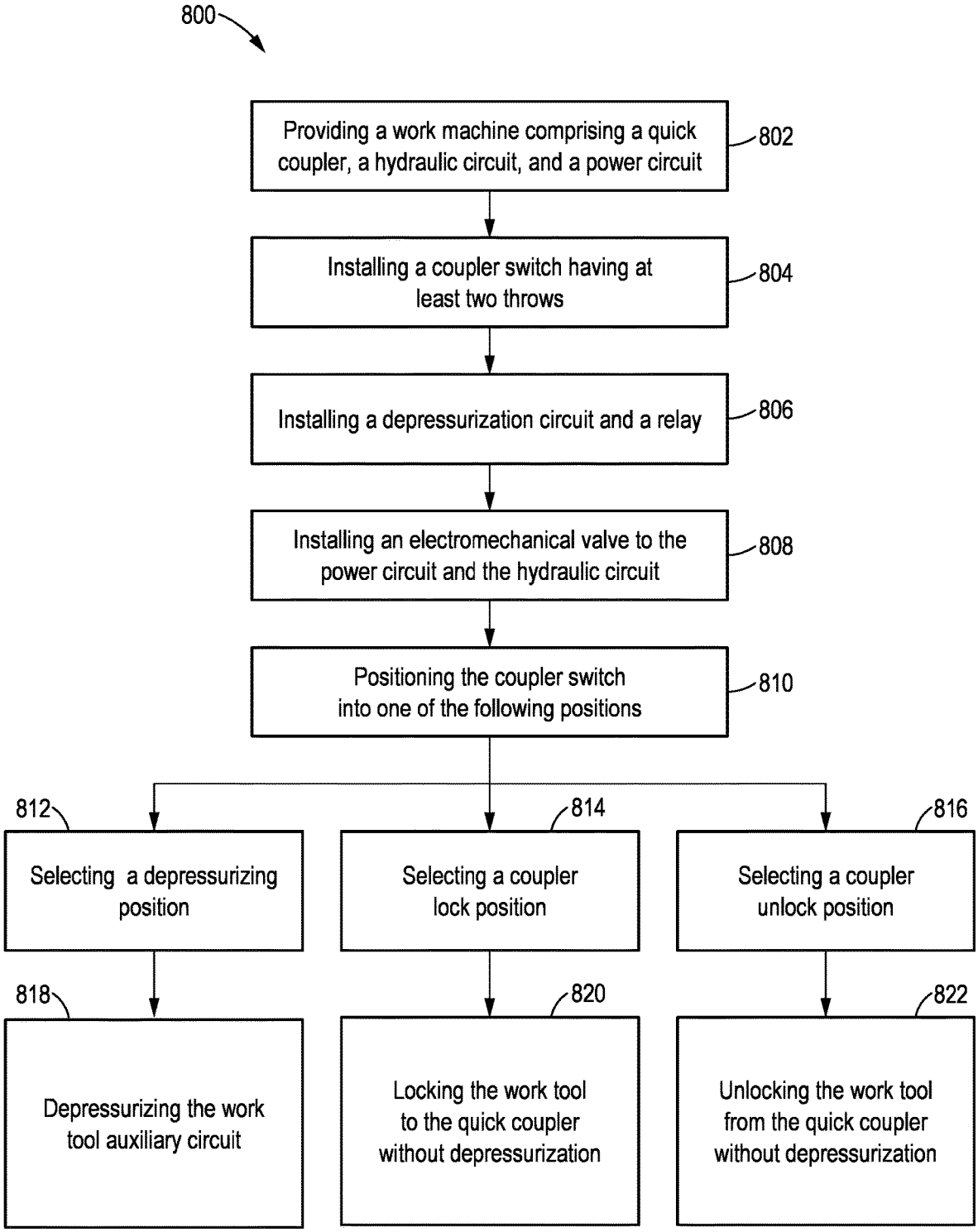
FIG. 8 is a flow chart of a method of installing a depressurization kit of the hydraulic circuit on a work machine and selecting a function of a three-position coupler switch, according to a second embodiment.
Figure 9:
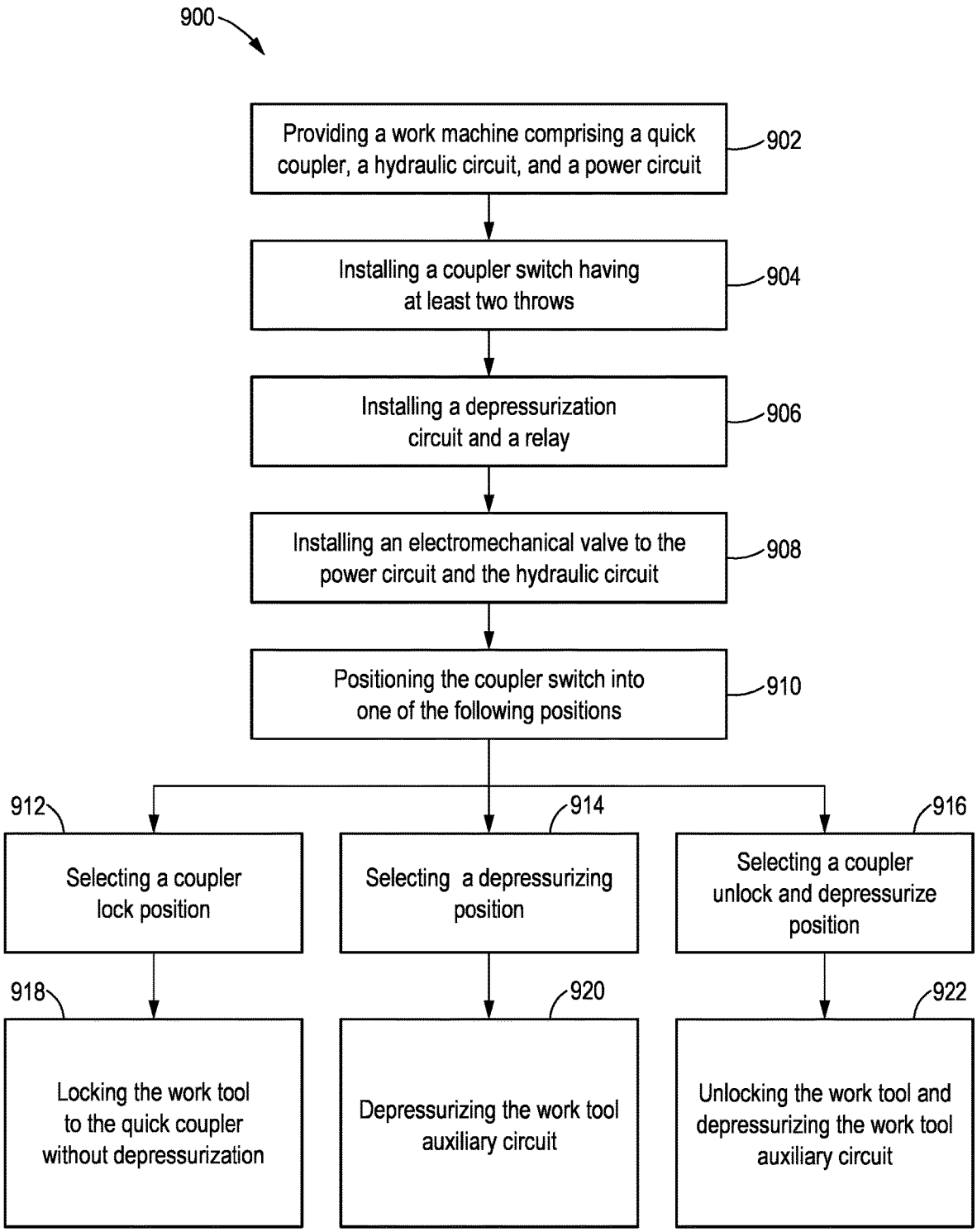
FIG. 9 is a flow chart of a method of installing a depressurization kit of the hydraulic circuit on a work machine and selecting a function of a three-position coupler switch, according to a third embodiment.

Referring to FIGS. 7-9, methods 700, 800, 900 of depressurizing a work tool auxiliary circuit of an existing work machine is disclosed herein. The methods 700, 800, and 900 illustrate various configurations of the three positions of the coupler switch 612 having at least two throws. In a first step 702, 802, 902, the work machine 100 is provided comprising an existing hydraulic circuit, an existing power circuit, and a quick coupler. The existing hydraulic circuit of an existing work machine in the field generally comprises hydraulic fluid, the plurality of hydraulic lines 118, the pressure source 402, the reservoir 404 for storing the hydraulic fluid, and the control valve 406. The existing power circuit of an existing work machine generally includes the power source 602 and quick coupler controller 610 connected to an existing switch with only two-positions, lock and unlock, with only one throw in the existing switch.

In a step 704, 804, 904 the coupler switch 612 having three positions is connected to the quick coupler controller 610 and the power circuit 600. The coupler switch 612 with three-positions may replace an existing switch of the work machine 100. Generally, existing control switches on current work machines in the field only have two positions, lock and unlock positions. The coupler switch 612 upgrades the existing control switch from a two-position switch to a three-position switch to allow for an additional depressurization function.

The coupler switch 612 provided in step 704, 804, 904, may be a double throw switch having at least two throws. With a double throw switch, the wiring circuit to a new coupler switch 612 can be easily changed at the existing switch location of the work machine 100 by changing the location of the existing wires at the switch to be able to adapt to a variety of hydraulic connecting quick couplers and machine systems. The logic for activating depressurization can easily be changed for different applications by changing the wiring of the existing switch for accommodating varying configurations of the three-position in the coupler switch 612. By utilizing a double throw switch as the coupler switch 612, the electric circuit connecting the quick coupler controller 610 to the coupler switch 612 to activate the quick coupler controller 610 will be a separate circuit from the activation circuit 604, in communication with the relay 608, and the relay circuit 606, in communication with the electromechanical valve 408. This allows the relay circuit 606 to easily be integrated in a wide range of machines and from different OEM manufactures.

In a step 706, 806, 906, the depressurization circuit 620 is installed which connects a relay 608 to the coupler switch 612 and the electromechanical valve 408 that is installed in a step 708, 808, 908 to the work tool auxiliary circuit 400 and depressurization circuit 620. The relay 608 is installed between the coupler switch 612 and the electromechanical valve 408. The relay 808 is connected to the coupler switch 612 via the activation circuit 604 and connected to the electromechanical valve 408 via the relay circuit 606 after installation to the power circuit 600. Utilizing the relay 608 allows for smaller electrical wires to be brought within the cab of the machine as the wires at the coupler switch are generally not load carrying.

In a step 708, 808, 908, the electromechanical valve 408 is connected to the plurality of hydraulic lines 118 of the work machine 100 by connecting the electromechanical valve 408 to the reservoir 404 with the depressurize line 410, as illustrated in FIGS. 4-5. The electromechanical valve 408 is electrically connected to the power circuit 600 and supports depressurization by bleeding the pressure in the work tool auxiliary circuit 400 by temporarily connecting the plurality of hydraulic lines 118 to the reservoir 404 so that hydraulic fluid is returned to the reservoir 404 when pressure is released after actuating the electromechanical valve 408 with the coupler switch 612. A person having ordinary skills in the art would recognize that using independent electromechanical valves increases versatility of the kit and makes it easy to integrate into a variety of work machines.

When the hydraulic system is actuated by the coupler switch 612, the work tool auxiliary circuit 400 is powered by the power circuit 600. The power circuit 600 powers the work tool auxiliary circuit 400 for unlocking and locking the quick coupler 114 via the locking circuit 622 when the coupler switch 612 selects a lock or unlock position. When the coupler switch 612 connected to the power circuit 600 selects a depressurization position, the depressurization circuit 620 sends a signal to depressurize the work tool auxiliary circuit 400. When an operation signal is selected from the three positions on the coupler switch 612 having at least two throws, the operations of the electromechanical valve 408 and the hydraulic block can be controlled to unlock or lock the quick coupler 114 to the work tool 116 and/or depressurize the work tool auxiliary circuit 400, depending on the chosen logic for the three-positions of the coupler switch 612.

For example, as illustrated in FIG. 7, the three switch positions in a first configuration may be set so that an operator may select (1) a coupler lock position in step 712, (2) a coupler unlock position in a step 714, and (3) a coupler unlock and depressurize position in a step 716. This first configuration allows for an operator of the work machine 100 to be able unlock the quick coupler 114 with or without depressurization which is beneficial in applications where a separate work tool 116, such as a thumb, is currently utilizing the same hydraulic circuit used by hydraulic connecting quick couplers. Selecting (1) a coupler lock position, in step 712, actuates locking the work tool 116 to the quick coupler 114 without depressurization, shown in a step 718. Selecting (2) a coupler unlock position, in step 714, actuates unlocking the work tool 116 to the quick coupler 114 without depressurization, shown in a step 720. This coupler switch 612 configuration allows the quick coupler 114 to be unlocked without depressurizing the auxiliary hydraulic circuit of the work tool 116. Selecting (3) a coupler unlock and depressurize position, in a step 716, actuates unlocking the work tool and simultaneously depressurizing the work tool auxiliary circuit 400 by simultaneously actuating the electromechanical valve 408 to return hydraulic fluid to the reservoir 404 during unlocking via the depressurization circuit 620 and the locking circuit 622, as shown in a step 722. When the electromechanical valve 408 is actuated it temporarily connects the plurality of hydraulic lines 118 to the reservoir 404 so that the hydraulic fluid is transferred to the reservoir 404. It may be recognized by one skilled in the art that the plurality of hydraulic lines 118 may be a primary hydraulic line or a secondary hydraulic line.

As illustrated in FIG. 8, the three switch positions of the coupler switch 612 in a second configuration may be set as (1) Depressurize, (2) Coupler Locked, and (3) Coupler Unlocked. This configuration allows for depressurization of the work tool auxiliary circuit 400 to be independent from the coupler unlock switch selection. For some applications of the work machine 100, the duration of the depressurization process needs to be limited to limit tool drift while also requiring the depressurization process to occur prior to disengaging the quick coupler 114. Selecting the (1) depressurize position, in a step 812, actuates depressurizing the work tool auxiliary circuit 400 by actuating the electromechanical valve 408 via the depressurization circuit 620 to return hydraulic fluid to the reservoir 404 during unlocking, as shown in a step 818. Selecting the (2) coupler lock position, in step 814, actuates locking the work tool 116 to the quick coupler 114 without depressurization via the locking circuit 622, shown in a step 820. Selecting the (3) coupler unlock position, in step 816, actuates unlocking the work tool 116 to the quick coupler 114 without depressurization via the locking circuit 622, shown in a step 820. This coupler switch 612 configuration allows the quick coupler 114 to be unlocked without depressurizing the auxiliary hydraulic circuit of the work tool 116.

As illustrated in FIG. 9, the three switch positions of the coupler switch 612 in a third configuration may be set as (1) Coupler Lock, (2) Depressurize, and (3) Coupler Unlock and Depressurize. This configuration forces the operator of the work machine 100 to utilize a depressurization function. Some hydraulic connecting quick couplers require depressurization all the time during the coupling and/or uncoupling process. This configuration requires the operator to always be required to depressurize when unlocking the quick coupler 114 from the work tool auxiliary circuit 400. Selecting (1) a coupler lock position, in step 912, actuates locking the work tool 116 to the quick coupler 114 via the locking circuit 622 without depressurization, shown in a step 918. Selecting the (2) depressurize position, in a step 814, actuates depressurizing the work tool auxiliary circuit 400 by actuating, via the depressurization circuit 620, the electromechanical valve 408 to return hydraulic fluid to the reservoir 404 via the depressurization circuit 620, as shown in a step 920. Selecting (3) a coupler unlock and depressurize position, in a step 922, actuates unlocking the work tool, via the locking circuit 622, and simultaneously depressurizing the work tool auxiliary circuit 400, by actuating the electromechanical valve 408, via the depressurization circuit 620, to return hydraulic fluid to the reservoir 404 during unlocking, as shown in a step 922.

By using the work tool auxiliary circuit 400 and power circuit 600, the quick coupler 114 can easily attach the work tool 116 to a hydraulic connecting quick coupler that requires depressurization of the work tool auxiliary circuit 400 to fully connect properly preventing tool drift.

The power circuit 600 for this depressurization kit was designed to allow for installation into most agricultural and construction machines that utilize a hydraulic connecting quick coupler without making major changes to the machines existing electrical power circuit and hydraulic system. The physical hardware changes to the work machine's existing hardware is replacing the existing coupler switch, having only two positions, with a coupler switch 612 having three positions and at least two throws.

Hydraulic connecting quick couplers are desirable to replace existing quick couplers on work machines, as work machines operating in the field do not have a depressurization function during the coupling process because traditional quick couplers do not require a depressurization function. Moreover, damage may occur to work tools during the coupling and/or uncoupling process if the pressure in the auxiliary hydraulic circuit of the work tool is too high. This can occur when the work machine 100 has been left out in the field for a period of time and, for example, the heat from the weather has raised the pressure within the circuits.

The three-position switch with a depressurization function provides advantages that a person having skills in the art would recognize. The hydraulic system disclosed herein protects the work tool 116 and work tool auxiliary circuit 400 from damage due to thermal expansion. Damage due to thermal expansion can occur when the work tool 116 is disconnected from the work machine 100 without bleeding pressure (depressurizing) from the work tool auxiliary circuit 400 prior to disconnecting the work tool 116 due to a pressure-build up within the work tool 116 that is higher than pressure tolerance of the work tool 116. For example, the work tool 116 may be capable of handling up to 3000 psi and on a cold day where the current pressure in the work tool 116 may be at 2800 psi. If an operator disconnects the work tool 116 from the work machine 100 on a cold day where the pressure within the work tool is at 2800 psi and if there is a large temperature swing the following day after the work tool is removed from the machine, when the work tool is still disconnected from the machine, the pressure in the work tool will increase significantly over the max designed pressure due to the thermal expansion of the oil that is trapped within the work tool. Reducing the pressure in the work tool auxiliary circuit 400 reduces the force that is required to connect the couplings or hydraulic block and provides an increase of ease in coupling the work tool 116 to the work machine 100. Reducing the pressure as described also increases life of the system components such as the hydraulic couplings 304, hydraulic block, guidance system, and locking system. The guidance system is responsible for the aligning the quick coupler coupling 300 with the work tool coupling 302 on the work tool bracket 200. Additionally, some hydraulic connecting quick couplers require reducing the pressure during coupling, as some hydraulic connecting quick couplers are designed in a way that they are physically not able to make a hydraulic connection to the work tool 116 without depressurizing and are not designed to make connections with large pressures trapped within the work tool auxiliary circuit 400. These hydraulic connecting quick couplers may be damaged without depressurization.

Depressurization of the work tool auxiliary circuit 400 provides an advantage of protecting the longevity of a work tool when unfavorable pressure in the work tool's hydraulic auxiliary circuit exists which could damage the work tool during coupling and uncoupling or during operation by the work machine. It is desirable that a depressurization function be provided onto existing work machines utilizing existing quick coupler circuits or power circuits in the work machine to protect the work tool as well as to accommodate installation of hydraulic connecting quick couplers that require depressurization during coupling and uncoupling to the work machine.

From the foregoing, it can be seen that the technology disclosed herein has industrial applicability in a variety of settings such as, but not limited to work machines in the construction and agricultural industries that utilize a quick coupler for connecting to various work tools.

What is claimed is:

1. A hydraulic system for depressurizing a work tool auxiliary circuit of a work machine, the hydraulic system comprising:

a power source for powering the hydraulic system;

a reservoir of hydraulic fluid;

a plurality of hydraulic lines;

a pressure source for supplying the hydraulic fluid throughout the plurality of hydraulic lines;

a control valve for regulating a flow of the hydraulic fluid;

a depressurize line connected to at least one of the plurality of hydraulic lines and the reservoir, the depressurize line includes an electromechanical valve for regulating a flow of hydraulic fluid in the depressurize line;

a controller configured to communicate with the electromechanical valve via a power circuit; and a coupler switch comprising at least three positions configured to communicate with the controller, at least one of the three positions actuates the electromechanical valve to depressurize the work tool auxiliary circuit.

2. The hydraulic system according to claim 1, wherein the coupler switch has at least two throws.

3. The hydraulic system according to claim 2, wherein the power circuit further comprises:

a locking circuit that includes a locking valve and an unlocking valve for connecting and disconnecting a work tool from a quick coupler of the work machine;

a depressurization circuit that includes an activating circuit, a relay circuit, and a relay between the activating circuit and the relay circuit, wherein the relay communicates with the coupler switch and the electromechanical valve; and the coupler switch communicates with the locking circuit and the depressurization circuit, at least one of the three positions of the coupler switch communicates with the depressurization circuit.

4. The hydraulic system according to claim 3, wherein the at least three positions of the coupler switch are selected from the groups of configurations consisting of:

a coupler lock position, a coupler unlock position, and a coupler unlock and depressurize position;

a depressurize position, a coupler lock position, and a coupler unlock position; and a coupler lock position, a depressurize position, and a coupler unlock and depressurize position.

5. The hydraulic system according to claim 4, wherein the quick coupler is a hydraulic connecting quick coupler and the work tool is a hydromechanical work tool.

6. The hydraulic system according to claim 2, wherein the hydraulic system is provided as a kit for installation on an existing work machine.

7. The hydraulic system according to claim 1, wherein the one of the plurality of hydraulic lines 118 is a secondary hydraulic line, and the depressurization line is connected to the secondary hydraulic line.

8. A work machine comprising:

a frame;

a ground engaging element supporting the frame;

an engine in the frame and powers the work machine;

a working mechanism extending from the frame;

a quick coupler on an end of the working mechanism for coupling to a work tool;

a hydraulic system including:

a power source for powering the hydraulic system;

a reservoir of hydraulic fluid;

a plurality of hydraulic lines;

a pressure source for supplying the hydraulic fluid throughout the plurality of hydraulic lines;

a control valve for regulating a flow of the hydraulic fluid;

a depressurize line connected to at least one of the plurality of hydraulic lines and the reservoir, the depressurize line includes an electromechanical valve for regulating a flow of hydraulic fluid in the depressurize line;

a controller configured to communicate with the electromechanical valve via a power circuit; and a coupler switch comprising at least three positions configured to communicate with the controller, at least one of the three positions actuates the electromechanical valve to depressurize a work tool auxiliary circuit.

9. The work machine according to claim 8, wherein the coupler switch is a double throw switch.

10. The work machine according to claim 9, wherein the power circuit further comprises:

a locking circuit that includes a locking valve and an unlocking valve for connecting and disconnecting the work tool from the quick coupler of the work machine;

a depressurization circuit that includes an activating circuit, a relay circuit, and a relay between the activating circuit and the relay circuit, wherein the relay communicates with the coupler switch and the electromechanical valve; and the coupler switch communicates with the locking circuit and the depressurization circuit, at least one of the three positions of the coupler switch communicates with the depressurization circuit.

11. The work machine according to claim 8, wherein the at least three positions of the coupler switch are selected from the groups of configurations consisting of:

a coupler lock position, a coupler unlock position, and a coupler unlock and depressurize position;

a depressurize position, a coupler lock position, and a coupler unlock position; and a coupler lock position, a depressurize position, and a coupler unlock and depressurize position.

12. The work machine according to claim 10, wherein the quick coupler is a hydraulic connecting quick coupler and the work tool is a hydromechanical work tool.

13. The work machine according to claim 8, wherein the one of the plurality of hydraulic lines 118 is a secondary hydraulic line, and the depressurization line is connected to the secondary hydraulic line.

14. A method of depressurizing a work tool auxiliary circuit of a work machine having a hydraulic system, the hydraulic system includes a plurality of hydraulic lines, a pressure source, a reservoir of hydraulic fluid, and a power circuit having a controller, the method comprising:

providing the work machine having a work tool and a quick coupler;

installing a coupler switch having at least three positions in connection with the controller, at least one of the three positions depressurizes the work tool auxiliary circuit;

installing a depressurization circuit and a relay to the controller;

installing a depressurize line and an electromechanical valve to the plurality of hydraulic lines, the reservoir, the electromechanical valve in communication with the relay; and depressurizing the work tool auxiliary circuit when a depressurize position is selected actuating the electromechanical valve to release pressure in the work tool auxiliary circuit.

15. The method according to claim 14, wherein the quick coupler is a hydraulic connecting quick coupler and the work tool is a hydromechanical work tool.

16. The method according to claim 14, wherein the power circuit further comprises:

a locking circuit that includes a locking valve and an unlocking valve for connecting and disconnecting the work tool from the quick coupler of the work machine;

the depressurization circuit includes an activating circuit, a relay circuit, and the relay between the activating circuit and the relay circuit, wherein the relay communicates with the coupler switch and the electromechanical valve; and the coupler switch communicates with the locking circuit and the depressurization circuit, at least one of the three positions of the coupler switch communicates with the depressurization circuit.

17. The method according to claim 16, wherein two electromechanical valves are provided in connection with the relay.

18. The method according to claim 17, wherein the one of the plurality of hydraulic lines 118 is a secondary hydraulic line, and the depressurization line is connected to the secondary hydraulic line.

19. The method according to claim 15, wherein the at least three positions of the coupler switch are selected from the groups of configurations consisting of:

a coupler lock position, a coupler unlock position, and a coupler unlock and depressurize position;

a depressurize position, a coupler lock position, and a coupler unlock position; and a coupler lock position, a depressurize position, and a coupler unlock and depressurize position.

20. The method according to claim 15, wherein the coupler switch includes at least two throws.

* * * * *